US007517076B2

(12) United States Patent
Stelter et al.

(10) Patent No.: US 7,517,076 B2
(45) Date of Patent: Apr. 14, 2009

(54) PHASE-CHANGE INK JET PRINTING WITH ELECTROSTATIC TRANSFER

(75) Inventors: Eric C. Stelter, Pittsford, NY (US); Joseph E. Guth, Holley, NY (US)

(73) Assignee: Eastman Kodak Company, Rochester, NY (US)

( * ) Notice: Subject to any disclaimer, the term of this patent is extended or adjusted under 35 U.S.C. 154(b) by 224 days.

(21) Appl. No.: 10/881,622

(22) Filed: Jun. 30, 2004

(65) Prior Publication Data

US 2006/0001722 A1 Jan. 5, 2006

(51) Int. Cl.
*B41J 2/39* (2006.01)

(52) U.S. Cl. ..... 347/103

(58) Field of Classification Search ..... 347/103
See application file for complete search history.

(56) References Cited

U.S. PATENT DOCUMENTS 3,898,670 A * 8/1975 Erikson et al. ..... 346/21
5,235,350 A * 8/1993 Lin et al. ..... 347/88
5,372,852 A 12/1994 Titterington et al.
5,389,958 A 2/1995 Bui et al.
5,614,933 A * 3/1997 Hindman et al. ..... 347/103
5,777,650 A 7/1998 Blank
5,864,774 A 1/1999 Jones
5,974,298 A 10/1999 Urban et al.
6,102,538 A 8/2000 Ochi et al.
6,113,231 A 9/2000 Burr et al.
6,126,274 A 10/2000 Kohyama
6,196,675 B1 3/2001 Deily et al.
6,279,474 B1 8/2001 Liebl
6,390,617 B1 5/2002 Iwao
6,427,591 B1 8/2002 Schmid
6,613,496 B1 9/2003 Inno et al.
6,682,189 B2 1/2004 May et al.
6,716,562 B2 * 4/2004 Uehara et al. ..... 430/124
6,719,423 B2 * 4/2004 Chowdry et al. ..... 347/103
6,761,446 B2 * 7/2004 Chowdry et al. ..... 347/103
6,932,469 B2 * 8/2005 May et al. ..... 347/103
2003/0067529 A1 4/2003 May et al. ..... 347/103

* cited by examiner

*Primary Examiner*—Matthew Luu
*Assistant Examiner*—Shelby Fidler

(57) ABSTRACT

A printing machine, comprising an intermediate medium; an ink jet printhead, for dispensing phase-change ink droplets at selected locations of a surface of the intermediate medium, the selected locations corresponding to an image to be printed; a receiver source, for providing a receiver; and a transfer station, for electrostatically transferring the dispensed phase-change ink droplets to the receiver.

28 Claims, 3 Drawing Sheets

PHASE-CHANGE INK JET PRINTING WITH ELECTROSTATIC TRANSFER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention is in the field of printing, and is more specifically directed to high-speed industrial ink jet printing.

As a result of continuing technological advances in the field, ink jet printing has become more popular in recent years, over a wider range of printing applications. For example, color ink jet printers with very high resolution (on the order of 600 dpi), and thus capable of photographic quality output, are now available even at consumer prices.

Ink jet printing is now also becoming popular in industrial applications. As mentioned above, ink jet printers provide excellent resolution at relatively low cost, and are especially attractive for the printing of small run jobs. Ink jet printers also can provide a great deal of flexibility in the printing of a wide range of formats. More specifically, ink jet printers appear especially attractive for wide format output (e.g., eighteen inches or wider), because electrographic or offset printing equipment for such wide format output is extremely costly.

However, high resolution and accuracy in ink jet printing requires not only small dot pitch for the ink as dispensed, but also close spacing between the ink jet printhead and the receiver sheet to minimize errors in ink drop placement (primarily due to variations in the angle of drop ejection from the printhead). Preferably, the printhead-to-receiver gap should be on the order of 1 mm or less. In conventional ink jet printers, however, such close spacing often results in contamination to the ink jet orifices from dust carried by the receiver, or from fibers of the receiver itself. The ink jet printhead may even become damaged by raised areas of the receiver itself, or by contaminants at the receiver surface, that actually touch the ink jets as the receiver passes by, especially in high-speed printers. In the industrial printing context, the control of this precise printhead-to-receiver spacing over the desired wide-format receiver width is also very difficult.

By way of background, U.S. Pat. Nos. 5,372,852; 5,389,958; 5,777,650; 5,864,774; 5,974,298; 6,102,538; 6,113,231; and 6,196,675 B1 describe ink jet transfer printing. In these references, ink jets dispense phase change ink, in the form of the image to be printed, onto an intermediate medium. The references disclose various types of intermediate media, examples of which include a roller, a web, and a belt, and also include a liquid intermediate surface disposed on such members. According to these references, the ink is transferred from the intermediate transfer surface to the receiver sheet by heat, or by the combination of heat and pressure.

U.S. Pat. No. 6,390,617 B1 describes some of the problems with this conventional phase-change ink jet transfer technique. As described in this reference, in some conventional approaches, the inked intermediate medium is heated, so that transfer to the receiver is effected by pressure of the heated intermediate medium against the receiver. The heating of the intermediate medium can result in expansion of the ink droplets, causing a tendency of the image to lose its shape on transfer. Also as described in this reference, some conventional approaches heated the receiver from the backside, rather than heating the intermediate medium. According to this reference, this approach requires excess heat and time, can cause shrinking or deforming of the receiver medium, and makes duplex printing problematic. This reference also discloses the heating of only the image side of the receiver, at transfer of the phase-change ink from the intermediate medium to the receiver.

In these hot-melt ink jet printers, either or both the receiver or the intermediate transfer surface must be heated. It is believed, in connection with this invention, that this heating tends to cause the ink to spread on transfer, resulting in degraded resolution and poor image fidelity. In addition, it is believed that the dispensed ink on the intermediate medium in these hot-melt ink jet printers is not completely cooled, and thus stays at least partially liquid while on the intermediate medium. For example, U.S. Pat. No. 6,196,675 B1 discloses that its ink droplets are dispensed onto a liquid intermediate transfer surface; in addition, while this reference discloses that its droplets are then cooled on the liquid intermediate transfer surface, the ink remains at an intermediate temperature so that the ink is in a "malleable" state. This instability in the ink is also believed to be subject to ink spreading, especially when different color inks are sequentially dispensed onto the intermediate transfer surface.

By way of further background, U.S. Pat. No. 6,279,474 B1 describes offset printing machines in which ink is initially delivered by ink jets to an ink form roller, which in turn transfers the ink it receives to the plate cylinder of the offset printing machine. U.S. Pat. No. 6,427,591 B1 describes offset printing machines in which ink jets deliver ink to an application roller or to a rotating mantle surface, which in turn delivers the ink to an application roller and ultimately to the plate cylinder. In each case, the ink jets permit close control of the amount of ink delivered to specific "zones" of the printed output, without requiring a complex sequence of braying rollers, blades, and the like.

By way of further background, the electrostatic transfer of polymer particles, using corona charge mechanisms, is well known in connection with conventional laser printers and copiers. As is well known in this art, the image is defined by the selective exposure of a charged photoconductor, for example by a raster-scanning laser. Toner ink particles are then attracted to the photoconductor in a pattern corresponding to the exposure of the image. The toner is then electrostatically transferred to a receiver, and fused using heat and pressure.

By way of further background, U.S. Pat. No. 6,126,274 describes a method of indirect printing in which toner particles, suspended in a dielectric fluid, are agglomerated and then dispensed by ink jets to an intermediate image holder in the form of an image to be printed. The toner particles are then electrostatically transferred to the receiver sheet, and the image is fused by heat and pressure.

By way of still further background, U.S. Pat. No. 6,682,189 B2 describes a method of indirect printing in which aqueous and non-aqueous inks, in the form of colloidal dispersions of pigment, are ink-jetted to form a coagulable ink image on an intermediate member, such as a roller or web. A coagulate formation process is performed on the jetted ink, and the liquid of the coagulated dispersion is then removed. The image is transferred to a receiver, with electrostatic and thermal transfer processes disclosed.

BRIEF SUMMARY OF THE INVENTION

It is an object of this invention to provide a high-resolution ink jet printer and method of operating the same that is capable of accurately printing on receivers of a wide range of formats.

It is a further object of this invention to provide such a printer and method that avoids ink spread at the receiver.

It is a further object of this invention to provide such a printer and method in which the ink jet printhead is less vulnerable to contamination or damage.

It is a further object of this invention to provide such a printer and method that maximizes the resolution of the image at the receiver.

It is a further object of this invention to provide such a printer and method in which high-resolution full color printing is attained.

Other objects and advantages of this invention will be apparent to those of ordinary skill in the art having reference to the following specification together with its drawings.

The present invention may be implemented into an ink jet printing machine, in which one or more ink jet printheads define the image to be printed by dispensing ink onto an intermediate receiver, such as a drum or roller. The ink is a phase change ink, preferably a wax-based ink, and dries on the intermediate receiver in the form of an image. The intermediate receiver then contacts a receiver sheet, at which point the ink, in the pattern of the image, is transferred to the receiver.

According to one aspect of the invention, the mechanism used to transfer the ink droplets from the intermediate to the ultimate receiver is electrostatic transfer. In this case, the intermediate receiver preferably has a low surface energy. Transfer of the dried ink to the receiver may be carried out by charging the ink droplets on the intermediate receiver to one polarity, and electrically biasing a transfer roller to the opposite polarity to attract the ink droplets to the receiver sheet between the intermediate receiver and the transfer roller.

DETAILED DESCRIPTION OF THE INVENTION

The present invention will be described in connection with its preferred embodiments, namely as implemented into an industrial size wide-format printing machine, because of the particular benefits provided by this invention in such an application. However, it is contemplated that this invention will also be beneficial in other applications of printing machines, and in connection with printing machines operating according to different mechanisms. Accordingly, it is to be understood that the following description is provided by way of example only, and is not intended to limit the true scope of this invention as claimed.

Figure 1:
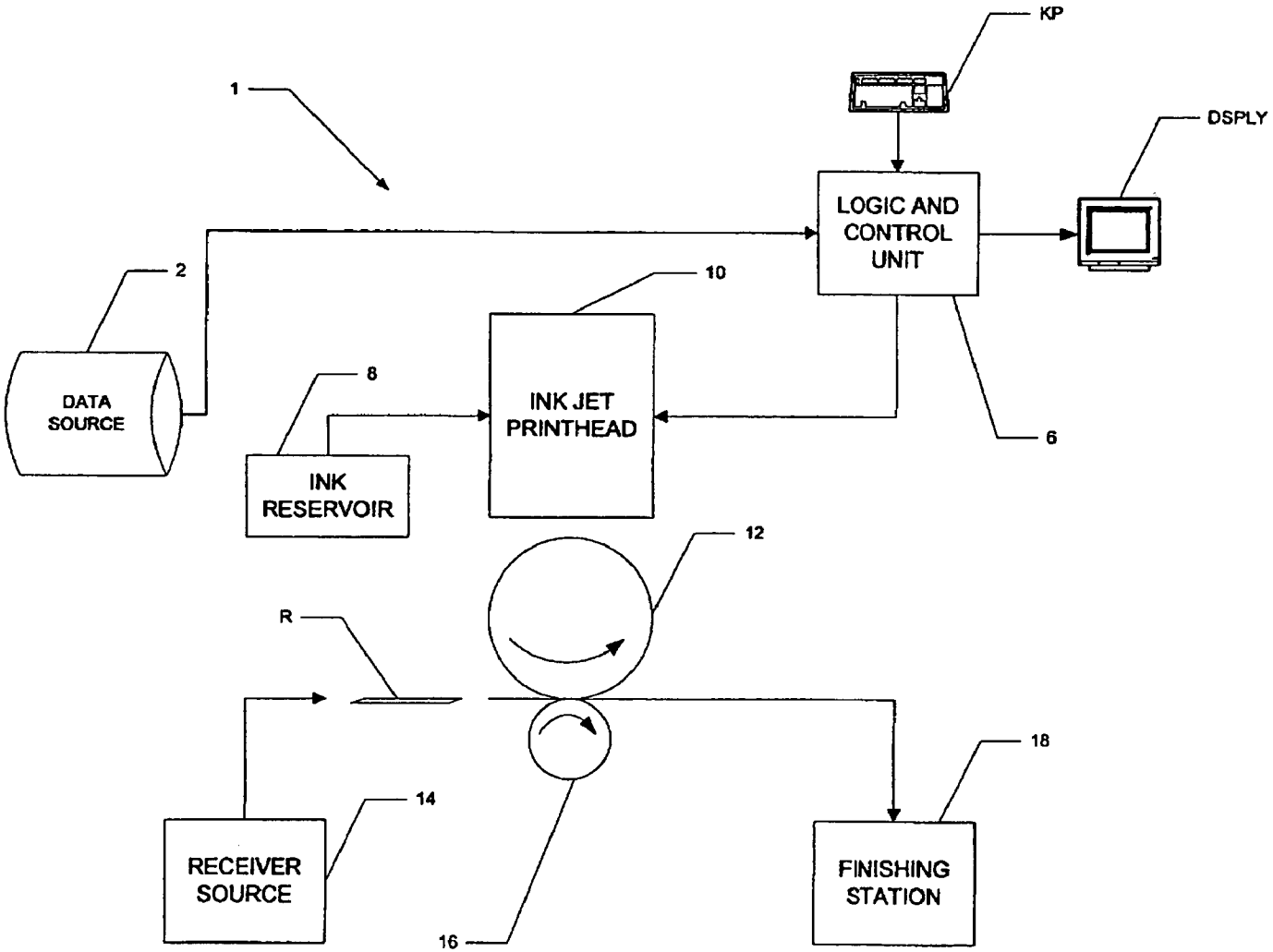
FIG. 1 is a schematic diagram of a printing machine according to the preferred embodiment of the invention.

FIG. 1 is a block diagram illustrating, in a general sense, the construction of printing machine 1 according to the preferred embodiment of the invention. Data source 2 generically refers to a source of the image to be printed; examples of data source 2 include disk or solid state memory that stores and receives digital data corresponding to the printed image, whether generated at a computer workstation, by a digital camera, or by a scanning system such as in the case of a photocopier. Data source 2 can refer to local memory or storage at printing machine 1 itself, or to memory that is in communication with printing machine 1 over a computer network or the like. Data source 2 is in communication with logic and control unit 6, which is preferably a microprocessor or microcomputer system or subsystem that controls the operation of printing machine 1, including the generation of signals that drive ink jet printhead 10 to draw the image to be printed. While a single functional block is shown in FIG. 1 as logic and control unit 6, it is contemplated that logic and control unit 6 may be realized in a single digital computer subsystem or integrated circuit, or by multiple integrated circuits deployed around printing machine 10. Logic and control unit 6 also receives user inputs from keypad KP, and presents status information to the user via display DSPLY.

In printing machine 1, ink jet printhead 10 receives signals from logic and control unit 6 corresponding to, among other control signals, data indicative of images to be printed. Ink jet printhead 10 is a conventional ink jet printhead, and as such dispenses ink to a target from one or more reservoirs 8, through one or more nozzles or "jets". As known in the art, if multiple jets are deployed at ink jet printhead 10, these jets may be arranged in a line perpendicular to the direction of travel of the target, or may be arranged in a two dimensional array. Ink jet printhead 10 may be a monochrome printhead, in which case one jet or set of jets is provided, or a multiple color (e.g., four-color) printhead, in which case a jet or set of jets is provided for each color component.

Several ink jet mechanisms are known in the art, each of which may be implemented in ink jet printhead 10 according to the preferred embodiment of the invention. Ink jet printhead 10 may be of the continuous type, which, in one embodiment, a continuous stream of electrically charged ink droplets from reservoir 8 are jetted from the nozzle; the image is then defined by the control signals controlling the electrostatic acceleration and deflection of the charged droplets, so that droplets are ejected from the nozzle, with some electrostatically deflected into a sump and the remainder reaching the target. Alternatively, ink jet printhead 10 may be of the "drop-on-demand" type, in which case the control signals from logic and control unit 6 directly control the ejection of droplets from the nozzle. In drop-on-demand ink jets, the production and ejection of the ink droplets can be effected by local pressure or temperature changes at the ink jet, using a piezoelectric or acoustic device at the ink jet nozzle, or by thermal processes as well known in the art.

According to the preferred embodiment of the invention, the ink stored in ink reservoir 8 and jetted from printhead 10 is a phase-change ink, also referred to as a "hot melt" ink. These inks change from liquid to solid phases in response to changes in temperature. Preferably, the ink used by printing machine 1 according to the preferred embodiment of the invention is a wax-based phase-change ink. An example of preferred inks are the CRYSTAL HGP hot melt/phase-change inks available from Coates Electrographics. These inks are especially suitable for dispensing through heated piezoelectric ink jet printheads.

As shown in FIG. 1, and according to the preferred embodiment of the invention, ink jet printhead 10 jets phase-change ink to intermediate medium 12, in one or more colors and in a pattern corresponding to the image to be printed. Intermediate medium 12 may correspond to a roller (as suggested in FIG. 1) or alternatively may be in the form of a looped belt or web, similar to that in conventional photocopiers and digital electrographic printers. In any case, intermediate medium 12 can have a width that is as large as desired, including very large widths beyond conventional paper widths (e.g., twenty-four inches and greater) as may be useful in industrial printing applications; in such a case, printhead 10 preferably is mounted to a carriage or other mechanism that enables it to dispense ink droplets along the full working width of intermediate medium 12. Intermediate medium 12 may be comprised of an electrically insulative, thermally conductive material, or, preferably, an electrically insulative layer on a thermally conductive and electrically conductive base. The material should have sufficient thermal conductivity that phase change ink solidifies between the inkjet printhead 10 and the transfer roller 16. Larger magnitudes of thermal conductivity may be used. To this end, it may be thermally controlled to obtain this result. That is, the temperature of the roller may be controlled to remain at the desired temperature. A cooling mechanism inside or external to the roller may be used. Air, for instance, may be blown across the roller surface to obtain this result.

The ink image, after dispensing by printhead 10 onto intermediate medium 12, dries as it is moved along the surface of intermediate medium 12, to a location adjacent to transfer roller 16. For printing multiple colors, the ink of a first color may be partially or fully dried before the ink of a second color is deposited, and so forth for all additional color inks to be printed. In the example of FIG. 1, intermediate medium 12 rotates, so that its surface locations travel toward transfer roller 16.

According to this preferred embodiment of the invention, receiver source 14 stores receivers R, which may be paper or another medium type onto which the image is to be transferred, and moves receivers R along a path toward finishing station 18. Printing machine 1 thus includes the appropriate mechanisms (not shown) for moving receiver R along this path, such mechanisms being well known in the art for printing machines. FIG. 1 illustrates an example of receiver R as a cut sheet of paper, plastic, or the like; alternatively, receiver source 14 may house a roller on which receiver R in the form of a continuous sheet may be retained and fed toward transfer roller 16. The receiver may be any of a number of media to which the ink is applied. Receiver R is passed between intermediate roller 12 and transfer roller 16, at which point the ink image is transferred from intermediate roller 12 to receiver R, in the manner to be described in further detail below. Receiver R then travels to finishing station 18, at which point it is formed and arranged into the desired output. For example, if receiver R is in the form of a continuous sheet, finishing station 18 will cut receiver R into the desired size. If receiver R is in the form of pre-cut sheets (or after the cutting of continuous receiver R), finishing station 18 can sort and collate multiple receivers R, and punch holes into, staple, and otherwise arrange the printed output in the conventional manner.

Figure 2:
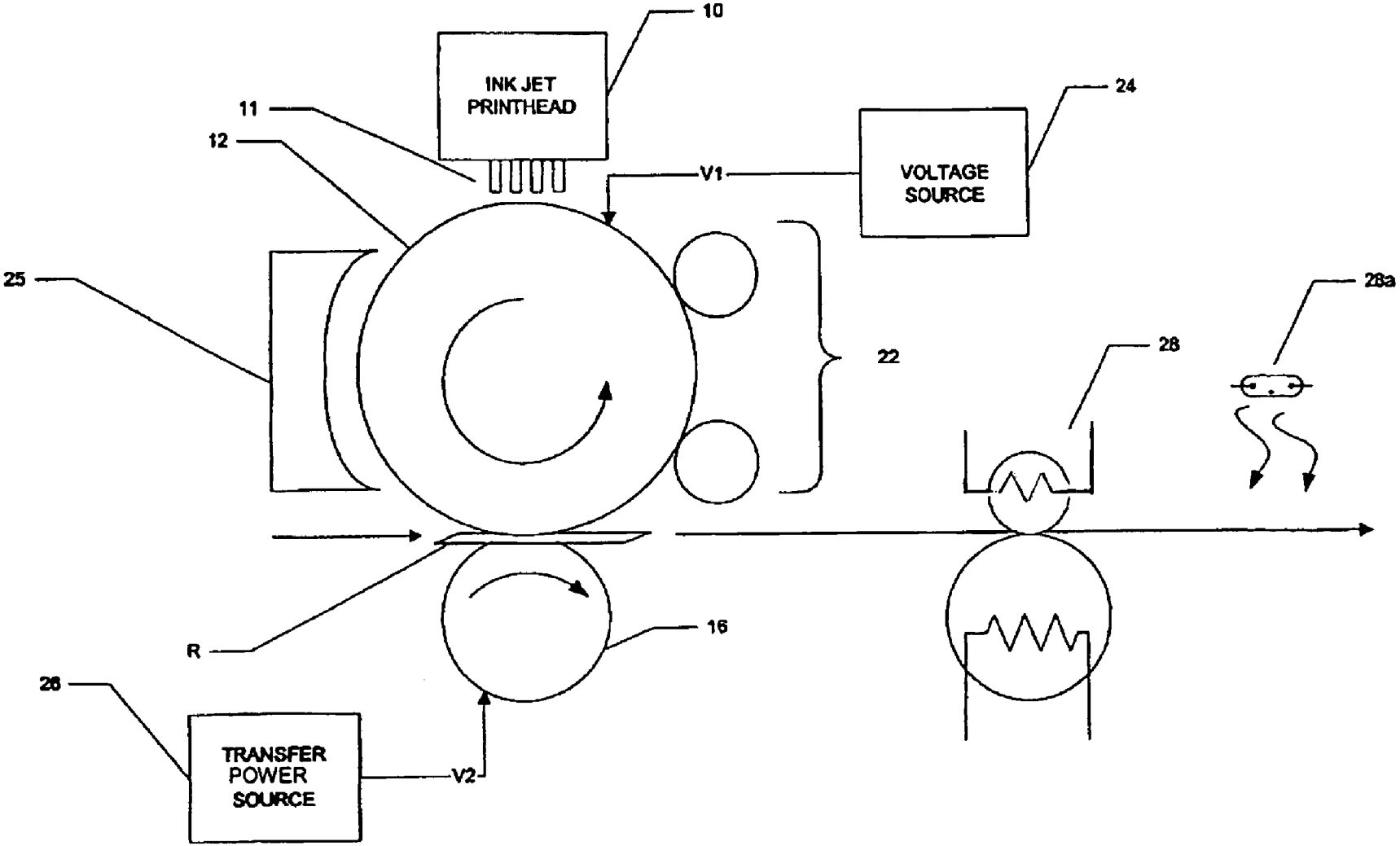
FIG. 2 is a schematic diagram, as a cross-sectional view, of a printing machine constructed according to a first preferred embodiment of the invention.

Referring now to FIG. 2, the construction and arrangement of certain portions of printing machine 1 according to the preferred embodiment of the invention will be described in further detail.

As shown in FIG. 2, ink jet printhead 10 includes multiple nozzles 11 aimed toward intermediate medium 12. For the preferred implementation in which wax-based phase-change inks are used, nozzles 11 are preferably heated piezoelectric ink jets. The heat applied by printhead 10 raises the temperature of the ink sufficiently that the ink liquefies, and is able to be piezoelectrically jetted from nozzles 11 at locations indicated by the image to be printed, as communicated by logic and control unit 6 (FIG. 1). In this example, one or more nozzles 11 are provided for each of multiple colors (e.g., black, red, blue, yellow). Preferably, nozzles 11 for separate colors are spaced apart from one another, so that the separate colors are sequentially deposited onto intermediate medium 12.

According to the preferred embodiment of the invention, it is contemplated that the wax-based phase-change inks harden very quickly upon impact with the surface of intermediate medium 12. Accordingly, it is preferred that intermediate medium 12 not be heated to a temperature near the melting point of the ink, as such heating would tend to maintain the ink in its liquid phase. To make the process independent of variations in ink coverage between successive images, It may be necessary to maintain intermediate member 12 at a fixed temperature or to cool intermediate member 12. If multiple color inks are being dispensed from printhead 10, nozzles 11 corresponding to different colors are preferably separated by enough distance to permit ink of one color to substantially harden before the next color ink is dispensed. This will limit ink spreading and image blurring that could otherwise be caused by the dispensing of a second ink on still-liquid droplets of a previously dispensed ink.

As mentioned above, intermediate medium 12 may be implemented in the form of a roller (as shown), or alternatively in the form of a web or belt. In any case, intermediate medium 12 may have a conductive inner core and a surface that has a low surface energy. This low surface energy may be most easily established by way of a coating at the surface of intermediate medium 12, with the composition of the coating being a semiconductive polyurethane, or a fluorocarbon polymer such as TEFLON polymer, or other fluorocarbon polymers such as those used on lithographic printing plates, as described in U.S. Pat. No. 6,613,496 B1. This low surface energy facilitates transfer of the hardened phase-change ink droplets to receiver R. Voltage source 24 may be a conventional voltage regulator or other voltage source, which in this embodiment of the invention applies a voltage V1 to intermediate medium 12. Alternately, intermediate member 12 may be electrically grounded. Voltage V1 facilitates the charging of ink and the electrostatic transfer of ink from intermediate medium 12 to receiver R.

Printing machine 1 further includes charger 25, disposed near the surface of intermediate medium 12 at a point between printhead 10 and transfer roller 16. As evident from FIG. 2, intermediate medium 12 is rotating about its axis in a counterclockwise direction, so that a given point on the surface of intermediate medium 12 traveling from near printhead 10 and nozzles 11 will pass by charger 25 before reaching transfer roller 16. Charger 25 applies an electrostatic charge to the ink droplets dispensed at the surface of intermediate medium 12, with the applied charge being of a selected polarity as will be described below. Various implementations of charger 25 are suitable in this preferred embodiment of the invention. For example, charger 25 may be a corona charger, similar to those used in conventional photocopiers and laser printers. Alternatively, charger 25 may be a roller charger that charges the dispensed ink droplets.

Still further in the alternative, a roller or corona charger may be disposed near intermediate medium 12 prior to printhead 10, in which case the charger would charge the surface of intermediate medium 12. In this case, charge would be triboelectrically transferred to the ink droplets, for example in thermal agitation of the ink. Still further in the alternative, the phase change ink could be realized as a semiconductive material by adding sulfonates or the like, in which case the ink droplets can be charged by induction from the charged surface of intermediate medium 12 or from an adjacent roller. If semiconductive ink is used, intermediate roller 12 may be conductive and electrically biased by voltage source 24, allowing the ink to be charged by injection from intermediate roller 12.

Transfer roller 16 is disposed near the surface of intermediate medium 12, at a location downstream from charger 25 according to the preferred embodiment of the invention. According to this embodiment of the invention, transfer roller 16 is either in contact with, or in very close proximity to, intermediate medium 12. The path of receiver R passes between intermediate medium 12 and transfer roller 16. Transfer voltage source 26 may be a conventional voltage regulator, current source, power supply, or other source of voltage V2, which is applied to and biases transfer roller 16. As will be described in further detail below, voltage V2 is selected so that the charged ink droplets electrostatically transfer from intermediate medium 12 toward transfer roller 16, but deposit on receiver R as a result of this transfer.

Alternatively, a corona charger may be deployed in place of biased transfer roller 16, producing the appropriate charge density on receiver R for causing transfer of the charged ink droplets from intermediate medium 12 onto receiver R.

The path of receiver R carries it to fusing station 28, according to this example of the preferred embodiment of the invention. In this example, fusing station 28 is constructed as two opposing rollers, at least one of which is heated as shown in FIG. 2. According to this embodiment of the invention, in which ink droplets are electrostatically transferred to receiver R, fusing station 28 thermally fixes the image onto receiver R, by melting and pressing the transferred phase-change ink droplets to receiver R; subsequent cooling resolidifies the ink within the fibers of receiver R. If the phase-change ink used by printing machine 1 includes a UV-curable component, printing machine 1 may additionally (or alternatively) include UV source 28*a*, for fusing the ink to receiver R by cross-linking the molecules of the ink droplets.

Various other fusing alternatives are also available. For example, transfer roller 16 may itself be heated, so that the electrostatic transfer and fusing processes occur simultaneously. In addition, UV source 28*a* may be deployed at or within fusing station 28, or at the location of transfer roller 16. It is contemplated that the implementation of these and other alternative fusing approaches will be apparent to those skilled in the art having reference to this specification.

Cleaning station 22, such as a brush, blade, or web as is well known, is located downstream of transfer station 16 and proximate to intermediate receiver 12. Cleaning station 22 removes residual phase-change ink from the surface of intermediate medium 12. A pre-clean charger (not shown) may be located before or at cleaning station 22 to assist in this cleaning. After cleaning, the cleaned portion of intermediate medium 12 is then ready for recharging and receipt of phase-change ink for the next image.

Figure 3:
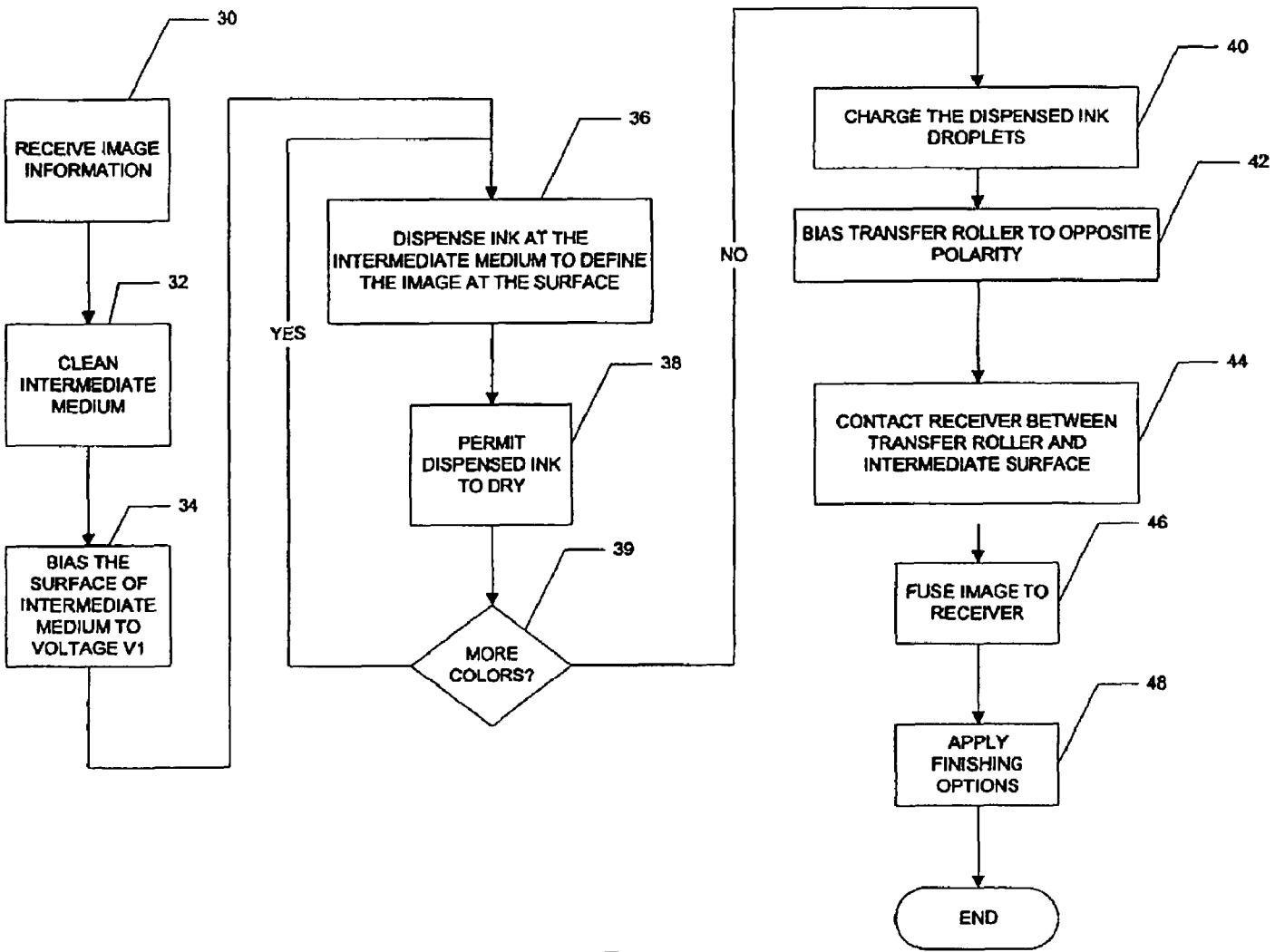
FIG. 3 is a flow chart illustrating the operation of the printing machine of FIG. 2 according to the first preferred embodiment of the invention.

The operation of printing machine 1 according to the preferred embodiment of the invention will now be described in detail, with reference to FIG. 2 and to the flow chart of FIG. 3, and for a given single receiver sheet R. Of course, as known in the art, most printing jobs involve multiple copies, and as such it is contemplated that printing machine 1 according to the preferred embodiment of the invention is as well-suited for printing many images in rapid sequence, indeed in a "pipelined" fashion with multiple receivers R at various stages of the printing process at any given time.

Printing begins with process 30, in which the data or other information defining the image to be printed is received by printing machine 1. Referring back to FIG. 2, for a particular image, a corresponding portion of intermediate medium 12 is being cleaned by cleaning station 22 in process 32, and the surface of intermediate medium 12 is biased to voltage V1 by voltage source 24 in process 34.

In process 36, a portion of the cleaned and biased surface of intermediate medium 12 is disposed at ink jet printhead 10, and ink is dispensed by printhead 10 through its nozzles 11 according to the image information received by printing machine 1 in process 30. This process 36 is preferably performed for a single color of wax-based phase-change ink, and the dispensed ink is allowed to dry in process 38. It is contemplated that conventional phase-change inks will solidify quite rapidly, in which case drying process 38 may occur simply as intermediate medium 12 is rotated about its axis. If decision 39 indicates that additional colors are to be printed (YES), then processes 36, 38 are repeated for those additional colors. Considering the close proximity of conventional ink jet nozzles for color printing, it is contemplated that an earlier part of the image may be receiving ink of one color simultaneously with a subsequent portion of the image receiving ink of a different color. It is contemplated that the printing of phase-change ink by way of processes 36, 38 and decision 39 may be similar to conventional ink-jet printing.

Once all colors of ink are dispensed (decision 39 is NO), charger 25 charges the dispensed ink droplets at the surface of intermediate medium 12 in process 40, preferably as intermediate medium 12 passes by charger 25. Because the dispensed ink droplets are substantially dry at this point (process 38), and because of their composition and the composition of the surface of intermediate medium 12, it is contemplated that the charging of the dispensed ink droplets by charger 25 will be relatively easy, and that the ink droplets will hold this charge for some time. Meanwhile, in process 42, transfer roller 16 is biased to voltage V2, of an opposite polarity to that which the ink droplets were charged by charger 25, and to a significant differential voltage relative to bias voltage V1. For example, assuming that the ink droplets are charged to a negative voltage, bias voltage V2 would be more positive than voltage V1, for example by about 600 volts.

In process 44, the ink droplets in the form of the image to be printed are electrostatically transferred from intermediate medium 12 to receiver R, as receiver R is placed between transfer roller 16 and the portion of the surface of intermediate medium 12 with the ink droplets of the image to be printed. It is contemplated that, with a reasonably low surface energy at intermediate medium 12, the electrostatic transfer of the ink droplets to receiver R will be relatively easy.

An example of the ease of electrostatic transfer according to the preferred embodiment of the invention is instructive. Conventional corona chargers, for example as charger 25 in printing machine 1, typically charge photoconductors of a thickness of on the order of 18 μm to a voltage of about 600 volts (i.e., 2 statvolts). If one assumes a relative dielectric constant of 3.0 for the ink droplets as dispensed on intermediate medium 12 and a thickness of 18 μm for the ink layer, which is reasonable for wax-based phase-change ink, this charging effects a surface charge of about 270 esu/cm$^2$. For ink droplets having this surface charge density, the surface energy of a receiver at 600 volts would be increased by about 530 ergs/cm$^2$. This energy is significantly greater than the energy that is required to free the ink from a low surface energy intermediate medium 12, such as one coated with TEFLON polymer or the like. For example, for the surface energy of intermediate medium 12 and of the ink droplets both being about 50 mN/m, only about 100 ergs/cm$^2$ would be required to separate the ink from the surface, which is well below the 530 ergs/cm$^2$ for receiver R as biased to approximately 600 V by transfer roller 16. Accordingly, in process 44, the ink droplets corresponding to the image are transferred to receiver R.

It is contemplated that surface energies of about 100 mN/m or less, for the surface of intermediate medium 12, may be used. For example, the surface energy of Teflon, or poly (tetrafluoroethylene), is approximately 20 mN/m. Higher surface energy surfaces may be also used, but such surfaces may require higher energy charging of the ink droplets, and perhaps also a higher bias voltage V2 at transfer roller 16.

Following transfer process 44, one or more additional actions are taken to fuse the image to receiver R, in process 46. For example, referring to FIG. 2, fusing station 28 can carry out fusing process 46 by applying temperature and pressure to receiver R in the conventional manner. As mentioned above, fusing station 28 may alternatively be included with transfer roller 16, for example by heating transfer roller 16 and with the appropriate pressure between transfer roller 16 and intermediate medium 12. In the alternative case in which the ink includes a UV-curable component, fusing process 46 may also be carried out by the irradiation of receiver R with UV light from UV source 28*a*, as shown in FIG. 2. The polymer cross-linking effected by UV irradiation from UV source 28*a* is contemplated to provide additional stability in the resulting printed image.

The printing process is completed, for receiver R, in process 48, by the additional processing of printed receiver R according to the desired and selected finishing options. Such options include, as well known in the art, the tasks of sorting, collating, hole-punching, and stapling as performed in conventional printing machines and photocopiers.

The present invention provides many important advantages over conventional printers. First, the indirect ink jet printing effected according to this invention prevents the fouling and damaging of ink jet nozzles at the printhead, as can occur in direct ink jet printing, especially at high resolutions that require extremely close spacing between the receiver and the ink jets. By eliminating the need to closely space the receiver from the nozzle, it is possible to utilize ink jet printing according to this invention for wide-format printing, because the difficulty of maintaining close tolerance relative to rough and non-uniform receivers, over a wide span, is avoided. Furthermore, because the surface of the intermediate medium can be made extremely smooth and free from contamination, the ink jet nozzles can be maintained extremely close to the intermediate surface, reducing dot placement errors still further. In addition, the rapid solidifying of the phase-change ink on the intermediate medium according to this invention maintains the high resolution of the ink jet printing, even in the multi-color context. Furthermore, the receiver sheet need not be heated, because of the electrostatic transfer according to this invention, which reduces ink spread at the receiver, enabling small ink droplet dot sizes to be maintained throughout the process. Higher quality printed images, over a wide range of receiver sizes, are therefore provided by this invention.

While the present invention has been described according to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

What is claimed is:

1. A printing machine, comprising:

an intermediate medium;

hot melt/phase-change ink;

an ink jet printhead dispensing hot melt/phase change ink in droplets at selected locations of a surface of the intermediate medium, the selected locations corresponding to an image to be printed, a cooling mechanism for blowing air across the surface of the intermediate medium for controlling the temperature of the intermediate medium;

wherein the cooling mechanism is configured to maintain the surface of the intermediate medium at a temperature sufficient to cool and fully dry the hot melt/phase-change ink droplets, a receiver source providing a receiver; and a transfer station electrostatically transferring the dry, dispensed hot melt/phase-change ink droplets from the intermediate medium to the receiver.

2. The printing machine of claim 1, wherein the surface of the intermediate medium moves from a location near the printhead to the transfer station;

and wherein the dispensed ink droplets harden at the surface of the intermediate medium as the surface moves toward the transfer station.

3. The printing machine of claim 2, wherein the surface of the intermediate medium has a low surface energy.

4. The printing machine of claim 3, wherein the intermediate medium comprises a coating at the surface, the coating having a low surface energy.

5. The printing machine of claim 4, wherein the coating comprises a polymer.

6. The printing machine of claim 2, further comprising:

a charger, for charging the dispensed ink droplets at a location between the printhead and the transfer station, so that the ink droplets are charged as the surface of the medium moves from the printhead toward the transfer station.

7. The printing machine of claim 6, further comprising:

a power supply for biasing the surface of the intermediate medium to a first voltage;

and wherein the transfer station comprises:

a transfer member, disposed near the surface of the intemiediate medium at a location at which the receiver source passes a receiver;

a power source, for biasing the transfer member to a polarity that attracts the charged dispensed ink droplets toward the transfer member and onto the receiver.

8. The printing machine of claim 7, further comprising: a fusing station, for fusing The dispensed ink droplets onto the receiver; wherein the fusing station comprises:

a heated roller, for applying heat and pressure to the receiver.

9. The printing machine of claim 7, further comprising: a fusing station, for fusing the dispensed ink droplets onto the receiver; wherein the fusing station comprises:

an ultraviolet light source, for irradiating the ink droplets at the receiver;

wherein the phase-change ink includes an ultraviolet-light curable component.

10. The printing machine of claim 7, wherein the transfer member comprises a roller.

11. The printing machine of claim 7, wherein the transfer member comprises a corona charger.

12. The printing machine of claim 6, wherein the charger comprises:

a corona charger, disposed near the surface of the intermediate medium at a location between the printhead and the transfer station.

13. The printing machine of claim 6, wherein the charger comprises:

a roller charger, disposed near the surface of the intermediate medium at a location between the printhead and the transfer station.

14. The printing machine of claim 6, wherein the charger is disposed near the surface of the intennediate medium between the transfer station and the printhead, for charging the surface of the intermediate medium so that the ink droplets we triboelectrically charged upon dispensing on the surface.

15. The printing machine of claim 6, wherein the charger is disposed near the surface of the intennediate medium between the transfer station and the printhead, for charging the surface of the intermediate medium;

and wherein the phase-change ink comprises a semiconductive material;

and wherein the ink droplets are charged by induction from the surface of the intermediate medium.

16. The printing machine of claim 6, wherein the intermediate medium is biased by a voltage source;

and wherein the phase-change ink comprises a semiconductive material;

and wherein the ink droplets are charged by induction from the surface of the intermediate medium;

and wherein the intermediate medium is conductive.

17. The printing machine of claim 1, further comprising:

a data source, for storing image data corresponding to images to be printed; and a logic and control unit, coupled to the data source and to the printhead, for controlling the printhead responsive to image data.

18. The printing machine of claim 1, wherein the printhead comprises a plurality of nozzles, at least one nozzle associated with each of a plurality of colors.

19. The printing machine of claim 1, wherein said hot melt/phase-change ink is wax-based.

20. A method of printing an image at a receiver, comprising the steps of:

dispensing hot melt/phase change ink droplets at selected locations of a surface of an intermediate member;

cooling the dispensed ink droplets at the surface of the intermediate member until the dispensed ink droplets fully dry, by controlling the temperature of the surface of the intermediate member by means of a cooling mechanism for blowing air across the surface of the intermediate medium; and electrostatically transferring the dry, dispensed ink droplets from the intermediate member to a receiver.

21. The method of claim 20, further comprising:

electrostatically charging the hardened dry, dispensed ink droplets;

and wherein the transferring step comprises:

placing a receiver in proximity to the surface of the intermediate member;

biasing a transfer member, disposed on the opposite side of the receiver from the surface of the intermediate member, to a polarity relative to that of the surface of the intermediate member, so that the charged ink droplets are attracted toward the transfer member.

22. The method of claim 21, further comprising:

biasing the surface of the intermediate member.

23. The method of claim 21, further comprising:

moving the locations of the surface of the intermediate member at which ink droplets are dispensed from the printhead toward the transfer member;

wherein the charging step is performed by a charger disposed near the surface of the intermediate member between the printhead and the transfer member.

24. The method of claim 21, wherein the charging step comprises:

charging the surface of the intermediate member, so that the ink droplets are electrostatically charged upon dispensing on the surface.

25. The method of claim 20, further comprising:

repeating the dispensing and hardening steps for each of a plurality of colors.

26. The method of claim 20, further comprising: after the transferring step, fusing the transferred ink droplets to the receiver; wherein the fusing step comprises:

applying heat and pressure to the receiver.

27. The method of claim 20, further comprising: after the transferring step, fusing the transferred ink droplets to the receiver; wherein the fusing step comprises:

irradiating the ink droplets with ultraviolet light.

28. The method of claim 20, wherein said hot melt/phase-change ink is wax-based.

* * * * *

UNITED STATES PATENT AND TRADEMARK OFFICE

CERTIFICATE OF CORRECTION

PATENT NO. : 7,517,076 B2
APPLICATION NO. : 10/881622
DATED : April 14, 2009
INVENTOR(S) : Eric C. Stelter et al.

It is certified that error appears in the above-identified patent and that said Letters Patent is hereby corrected as shown below:

| Column | Line | |
|---|---|---|
| 10 | 8 | In Claim 1, delete “melt/phase change” and insert --melt/phase-change-- |
| 10 | 46-47 | In Claim 7, delete “intemiediate” and insert --intermediate-- |
| 10 | 53 | In Claim 8, delete “The” and insert --the-- |
| 11 | 12 | In Claim 14, delete “intennediate” and insert --intermediate-- |
| 11 | 15 | In Claim 14, delete “we” and insert --are-- |
| 11 | 18 | In Claim 15, delete “internnediate” and insert --intermediate-- |
| 11 | 46 | In Claim 20, delete “melt/phase change” and insert --melt/phase-change-- |
| 12 | 10 | In Claim 21, before “dry” delete “hardened” |

Signed and Sealed this
Twenty-sixth Day of April, 2011

David J. Kappos

David J. Kappos
*Director of the United States Patent and Trademark Office*